US008834292B2

(12) United States Patent
Tsuji et al.

(10) Patent No.: US 8,834,292 B2
(45) Date of Patent: Sep. 16, 2014

(54) IRON GOLF CLUB HEAD AND IRON GOLF CLUB

(75) Inventors: Kei Tsuji, Osaka (JP); Yukihiro Teranishi, Osaka (JP); Naoya Joichi, Osaka (JP); Yasuyuki Ohta, Osaka (JP); Noriyuki Tabuchi, Osaka (JP); Kazuhiro Doi, Osaka (JP)

(73) Assignee: Mizuno Corporation, Osaka (JP)

( * ) Notice: Subject to any disclaimer, the term of this patent is extended or adjusted under 35 U.S.C. 154(b) by 206 days.

(21) Appl. No.: 13/432,115

(22) Filed: Mar. 28, 2012

(65) Prior Publication Data

US 2012/0252600 A1 Oct. 4, 2012

(30) Foreign Application Priority Data

Mar. 31, 2011 (JP) ..... 2011-079660

(51) Int. Cl.

| | |
|---|---|
| ***A63B 53/04*** | (2006.01) |
| *A63B 59/00* | (2006.01) |
| *A63B 53/06* | (2006.01) |
| *A63B 69/36* | (2006.01) |
| *A63B 53/00* | (2006.01) |

(52) U.S. Cl.

CPC ..... *A63B 53/047* (2013.01); *A63B 2053/0416* (2013.01); *A63B 59/0092* (2013.01); *A63B 53/06* (2013.01); *A63B 69/3635* (2013.01); *A63B 2053/005* (2013.01); *A63B 2059/0003* (2013.01); *A63B 2209/00* (2013.01); *A63B 2209/10* (2013.01)

USPC ..... 473/332; 473/350; 473/349

(58) Field of Classification Search

CPC ..... A63B 69/3635; A63B 59/0092; A63B 2059/0003; A63B 2053/0416; A63B 53/047

USPC ..... 473/332, 349, 350

See application file for complete search history.

(56) References Cited

U.S. PATENT DOCUMENTS 5,316,298 A * 5/1994 Hutin et al. ..... 473/332
5,830,084 A * 11/1998 Kosmatka ..... 473/349

(Continued)

FOREIGN PATENT DOCUMENTS

EP 0642812 A2 3/1995
FR 2689771 A1 10/1993

(Continued)

OTHER PUBLICATIONS

Written Opinion of the International Searching Authority and Search Report regarding co-pending Japanese Patent Application No. PCT/JP2012/057756 dated May 28, 2012.

(Continued)

*Primary Examiner* — Benjamin Layno

(74) *Attorney, Agent, or Firm* — Troutman Sanders LLP; James E. Schutz

(57) ABSTRACT

An iron golf club head includes: a head portion; and a badge portion adhered to the head portion. The head portion includes: a face surface; and a back surface located behind the face surface. The badge portion is adhered to at least one of a first largest amplitude region where an amplitude in a fourth-order vibration mode of the back surface is the largest and a second largest amplitude region where an amplitude in a fifth-order vibration mode of the back surface is the largest. As a result, there can be obtained an iron golf club head and an iron golf club, in which by suppressing decrease in resonant time of the hitting sound and reducing the sound pressure of the hitting sound, the hitting sound and the hitting feeling can be improved.

5 Claims, 8 Drawing Sheets

(56) References Cited

U.S. PATENT DOCUMENTS

| | | | | |
|---|---|---|---|---|
| 6,042,486 | A * | 3/2000 | Gallagher | 473/329 |
| 7,476,162 | B2 * | 1/2009 | Stites et al. | 473/332 |
| 7,833,110 | B2 * | 11/2010 | Nakamura | 473/332 |
| 2006/0258480 | A1 | 11/2006 | Hou et al. | |
| 2009/0137339 | A1 * | 5/2009 | Nakano | 473/350 |
| 2010/0137072 | A1 | 6/2010 | Kumamoto et al. | |
| 2011/0028235 | A1 * | 2/2011 | Nakano | 473/332 |
| 2011/0028236 | A1 | 2/2011 | Takechi et al. | |
| 2012/0302369 | A1 * | 11/2012 | Ban | 473/346 |

FOREIGN PATENT DOCUMENTS

| | | |
|---|---|---|
| JP | 11347161 | 12/1999 |
| JP | 2010-148565 | 7/2010 |
| JP | 2011030837 | 2/2011 |

OTHER PUBLICATIONS

Supplementary European Search Report dated Mar. 3, 2014 for co-pending European Application 12763316.2.

* cited by examiner

IRON GOLF CLUB HEAD AND IRON GOLF CLUB

This nonprovisional application is based on Japanese Patent Application No. 2011-079660 filed on Mar. 31, 2011 with the Japan Patent Office, the entire contents of which are hereby incorporated by reference.

BACKGROUND OF THE INVENTION

1. Field of the Invention

The present invention relates to an iron golf club head and an iron golf club, and particularly to an iron golf club head having a badge portion adhered to a head portion, and an iron golf club.

2. Description of the Background Art

In recent golf clubs, not only wood golf clubs but also iron golf clubs require high restitution. In order to achieve an iron golf club with high restitution, reducing the thickness of a face is proposed. Since reducing the thickness of the face leads to increase in deflection of the face, a louder hitting sound is generated from the face. A recent research shows that a hitting feeling of the iron golf club is affected by the hitting sound, and also shows that some golfers feel that the hitting feeling decreases as the hitting sound becomes louder. The recent research also shows that some golfers feel that the hitting feeling is improved as the resonant time of the hitting sound becomes longer, and the hitting feeling decreases as the resonant time of the hitting sound becomes shorter.

Japanese Patent Laying-Open No. 2010-148565, for example, discloses a golf club head having an adherend bonded to a back surface. This adherend can absorb vibrations generated at the time of hitting. This adherend has a shape obtained by scaling down a planar shape of the back surface, and is bonded to a central portion of the back surface.

In the aforementioned golf club head, the adherend covers the central portion of the back surface largely, and thus, the vibrations generated at the time of hitting are greatly absorbed. As a result, the hitting sound level (sound pressure) decreases greatly. However, along with the hitting sound level (sound pressure), the resonant time of the hitting sound also decreases greatly. Therefore, the hitting feeling decreases because the resonant time of the hitting sound decreases.

SUMMARY OF THE INVENTION

The present invention has been made in light of the aforementioned problems, and an object of the present invention is to provide an iron golf club head and an iron golf club, in which by suppressing decrease in resonant time of the hitting sound and reducing the sound pressure of the hitting sound, the hitting sound and the hitting feeling can be improved.

An iron golf club head according to the present invention includes: a head portion; and a badge portion adhered to the head portion. The head portion includes: a face surface; and a back surface located behind the face surface. The badge portion is adhered to at least one of a first largest amplitude region where an amplitude in a fourth-order vibration mode of the back surface is the largest and a second largest amplitude region where an amplitude in a fifth-order vibration mode of the back surface is the largest.

As a result of earnest study, the inventors of the present invention have found that the hitting feeling is affected by the sound pressures in the fourth-order and the fifth-order vibration modes of the head portion. In other words, it has been recognized that the hitting sound and the hitting feeling are improved by reducing the sound pressures in the fourth-order and the fifth-order vibration modes. In the regions where the amplitudes in the fourth-order and the fifth-order vibration modes are the largest, the sound pressures in the fourth-order and the fifth-order vibration modes are the largest. Thus, as described above, the inventors of the present invention have obtained the following findings: since the badge portion is adhered to at least one of the first largest amplitude region where the amplitude in the fourth-order vibration mode of the back surface is the largest and the second largest amplitude region where the amplitude in the fifth-order vibration mode of the back surface is the largest, the hitting sound and the hitting feeling can be improved by reducing the sound pressure in at least one of the fourth-order vibration mode and the fifth-order vibration mode of the head portion.

In addition, the badge portion is adhered with specified size or range, not adhered to a large area like the entire back surface, and thus, decrease in resonant time of the hitting sound can be suppressed.

Thus, in the iron golf club head according to the present invention, the hitting sound and the hitting feeling can be improved by suppressing decrease in resonant time of the hitting sound and reducing the sound pressure in at least one of the fourth-order vibration mode and the fifth-order vibration mode.

Preferably, the aforementioned iron golf club head further includes: a first small amplitude region, which is arranged around the first largest amplitude region to define the first largest amplitude region and which is smaller in the amplitude in the fourth-order vibration mode than the first largest amplitude region; and a second small amplitude region, which is arranged around the second largest amplitude region to define the second largest amplitude region and which is smaller in the amplitude in the fifth-order vibration mode than the second largest amplitude region. The badge portion is adhered so as not to overlap with at least one of the first small amplitude region and the second small amplitude region. As a result, unnecessary decrease in resonant time of the hitting sound can be suppressed. In other words, decrease in resonant time of the hitting sound can be minimized. Therefore, decrease in resonant time of the hitting sound can be suppressed more effectively.

In the aforementioned iron golf club head, an area of the back surface to which the badge portion is adhered is preferably 38.6% or more and 40.9% or less of an area of the entire back surface. As a result, decrease in resonant time of the hitting sound can be suppressed more effectively.

In the aforementioned iron golf club head, the head portion preferably has a restitution coefficient of 0.8 or more. As a result, high restitution can be achieved and the hitting feeling can be improved.

An iron golf club according to the present invention includes: a shaft; a grip attached to one end of the shaft; and the aforementioned iron golf club head attached to the other end of the shaft on an opposite side of the grip. As a result, there can be obtained an iron golf club, in which by suppressing decrease in resonant time of the hitting sound and reducing the sound pressure in at least one of the fourth-order vibration mode and the fifth-order vibration mode, the hitting sound and the hitting feeling can be improved.

As described above, in the iron golf club head and the iron golf club according to the present invention, by suppressing decrease in resonant time of the hitting sound and reducing the sound pressure of the hitting sound, the hitting sound and the hitting feeling can be improved.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention will be described hereinafter with reference to the drawings.

First, description will be given to a configuration of an iron golf club head according to the embodiment of the present invention.

Figure 1:
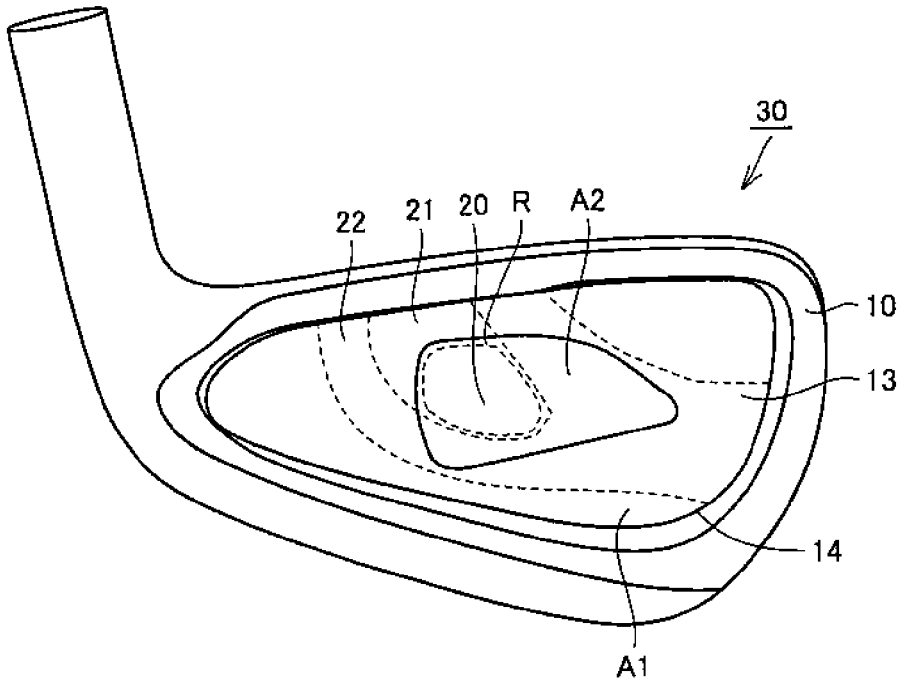
FIG. 1 is a schematic rear view of an iron golf club head according to an embodiment of the present invention.
Figure 2:
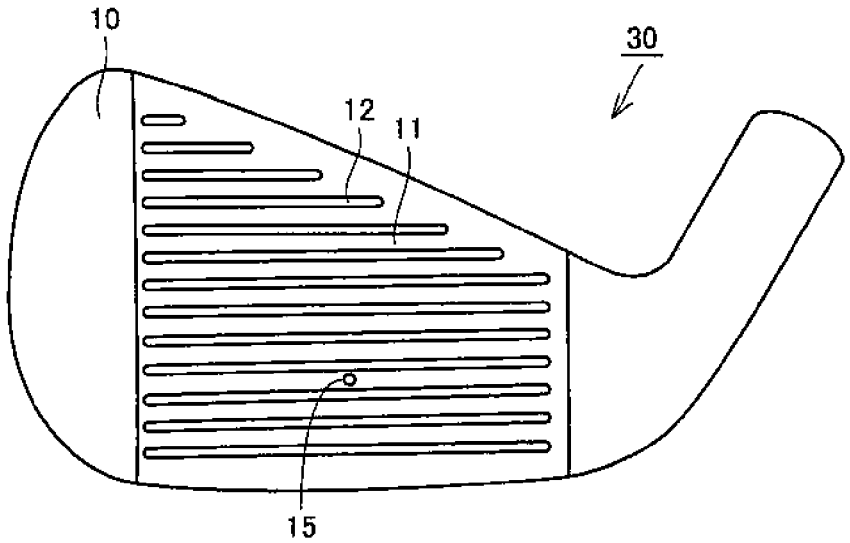
FIG. 2 is a schematic front view of the iron golf club head according to the embodiment of the present invention.

Referring to FIGS. 1 and 2, an iron golf club head 30 mainly has a head portion 10 and a badge portion 20 adhered to head portion 10. Head portion 10 has a face surface 11 that is a hitting surface. A plurality of grooves 12 are formed in face surface 11. The plurality of grooves (score lines) 12 are formed at substantially equal intervals in a direction vertically traversing face surface 11, and are formed in the shape of straight lines in a direction horizontally traversing face surface 11.

Head portion 10 also has a hosel portion to which a shaft is connected. Head portion 10 also has a top edge portion, a toe portion, a sole portion, and a heel portion located around face surface 11. The top edge portion is a portion forming an upper edge portion of head portion 10 extending from the hosel portion to the toe portion. The sole portion is a portion forming a bottom of head portion 10. The toe portion is a portion connecting the sole portion and the top edge portion on the side apart from the hosel portion. The heel portion is a portion extending from a lower end of the hosel portion to the sole portion.

Head portion 10 has a back surface 13 located behind (on a rear surface of) face surface 11. A cavity rising surface 14 is formed on the rear surface of face surface 11 to surround a peripheral edge thereof, and back surface 13 is a region surrounded by this cavity rising surface 14.

Badge portion 20 is adhered to back surface 13 of head portion 10 with specified size or range. Aluminum, stainless steel, brass, ABS, nickel, magnesium and the like can be applied as the material of badge portion 20. Badge portion 20 can be fabricated by using, for example, a material including JIS SUS304. Badge portion 20 is adhered to back surface 13. Badge portion 20 may be adhered to back surface 13 by, for example, a double-faced tape. Badge portion 20 is adhered to a first largest amplitude region 21 where an amplitude in a fourth-order vibration mode of back surface 13 is the largest.

The vibration mode of each order refers to the vibration mode (eigenmode) in an eigenvalue (natural frequency) of each order. Therefore, the fourth-order vibration mode refers to a vibration mode in a fourth-order eigenvalue. A region where the amplitude in the vibration mode is the largest is a region vibrating most strongly.

Badge portion 20 may be adhered to at least one of first largest amplitude region 21 where the amplitude in the fourth-order vibration mode of back surface 13 is the largest and a second largest amplitude region 23 (see FIG. 4E) where an amplitude in a fifth-order vibration mode of back surface 13 is the largest.

A first small amplitude region 22 that is smaller in amplitude in the fourth-order vibration mode than first largest amplitude region 21 is arranged around first largest amplitude region 21 to define first largest amplitude region 21. As shown by a region R in FIG. 1, badge portion 20 is preferably adhered so as not to overlap with first small amplitude region 22.

A second small amplitude region 24 (see FIG. 4E) that is smaller in amplitude in the fifth-order vibration mode than second largest amplitude region 23 is arranged around second largest amplitude region 23 to define second largest amplitude region 23.

Badge portion 20 may be adhered so as not to overlap with at least one of first small amplitude region 22 and second small amplitude region 24.

An area A2 of back surface 13 to which badge portion 20 is adhered may be 38.6% or more and 40.9% or less of an area A1 of the entire back surface 13. Area A1 of the entire back surface 13 is an area of a portion of back surface 13 surrounded by cavity rising surface 14.

Head portion 10 may have a restitution coefficient of 0.8 or more. When the restitution coefficient is 0.8 or more, head portion 10 has high restitution. A method for measuring the restitution coefficient will now be described. A speed measuring device having an optical sensor measures a speed (Vin) of a golf ball before collision and a speed (Vout) of the golf ball after collision when the golf ball collides with the center of score lines or a sweet spot position, with face surface 11 of iron golf club head 30 directed perpendicularly to the ground and the hit golf ball. Vin is 40.5±0.5 m/s.

Based on measured Vin and Vout, a mass M of iron golf club head 30, and a mass M of the golf ball, a restitution coefficient COR is measured in accordance with the following equation (1):

$$V\text{out}/V\text{in}=(COR\times M-m)/(M+m) \quad (1)$$

Pinnacle Gold LS sold by ACUSHINET COMPANY is used as the golf ball. The golf ball has an average weight of 45.4±0.4 grams, and during measurement, the golf ball is stored in a room where a temperature is kept at 23±1° C.

Head portion 10 can be fabricated by using, for example, a material including JIS S25C. Spring steel, maraging steel, stainless steel and the like can also be applied as the material of head portion 10. Head portion 10 can also be fabricated by forging.

Head portion 10 may also be plated. Head portion 10 may be, for example, Ni (nickel)-Cr (chrome) plated.

Figure 3:
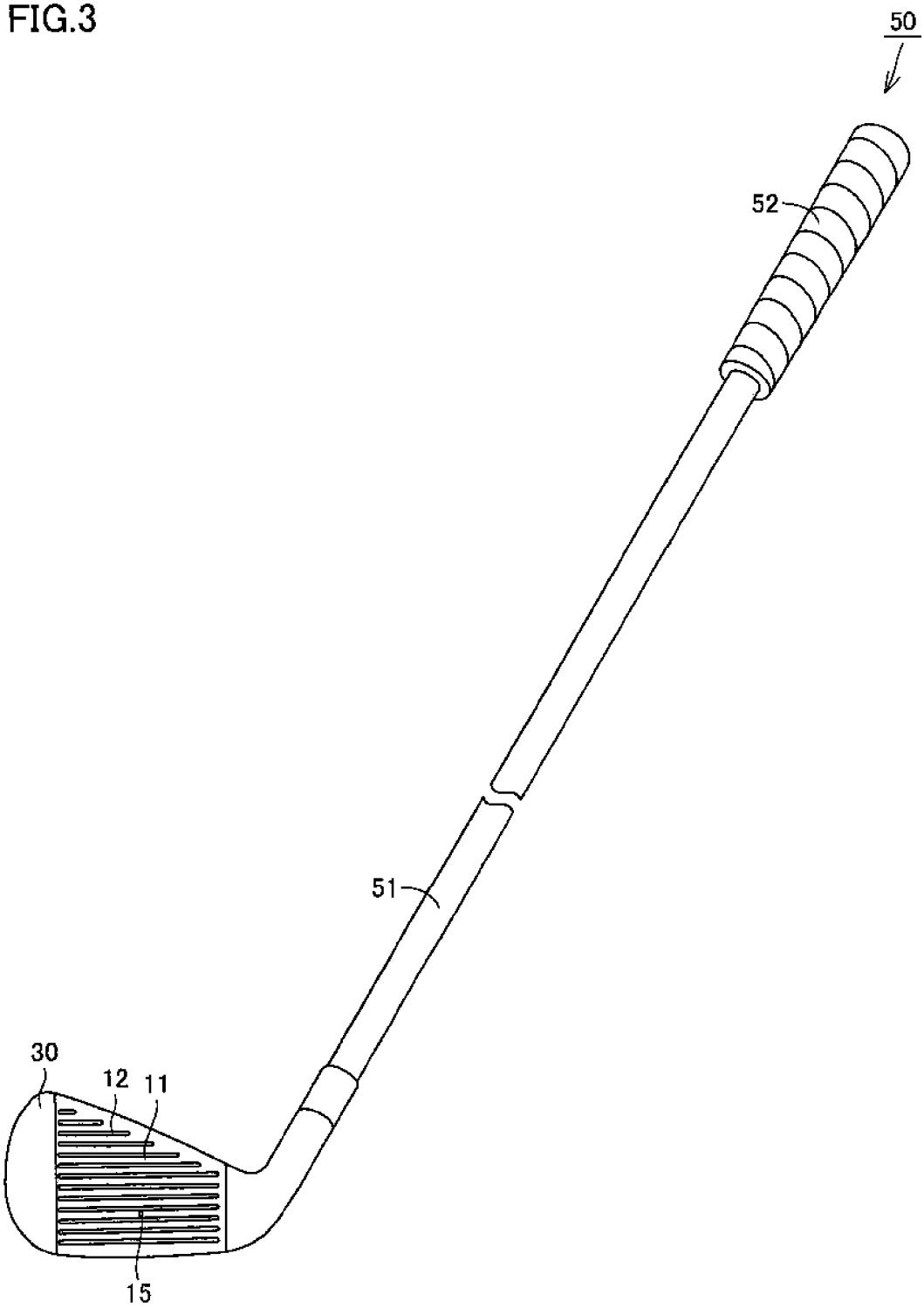
FIG. 3 is a schematic front view of an iron golf club according to the embodiment of the present invention.

Referring to FIG. 3, iron golf club head 30 is combined with a shaft 51 and a grip 52 to constitute an iron golf club 50.

Iron golf club 50 has shaft 51, grip 52 attached to one end of shaft 51, and iron golf club head 30 attached to the other end of shaft 51 on the opposite side of grip 52. A well-known shaft and a well-known grip can be used as shaft 51 and grip 52.

Next, the functions and effects of the embodiment of the present invention will be described.

The inventors of the present invention have obtained the following findings: since badge portion 20 is adhered to at least one of first largest amplitude region 21 where the amplitude in the fourth-order vibration mode of back surface 13 is the largest and second largest amplitude region 23 where the amplitude in the fifth-order vibration mode of back surface 13 is the largest, the hitting sound and the hitting feeling can be improved by reducing the sound pressure of head portion 10 in at least one of the fourth-order vibration mode and the fifth-order vibration mode.

In addition, badge portion 20 is adhered with specified size or range, not adhered to a large area like the entire back surface 13, and thus, decrease in resonant time of the hitting sound can be suppressed. In other words, since the size or range of area A2 of back surface 13 to which badge portion 20 is adhered is limited, decrease in resonant time of the hitting sound can be suppressed.

Therefore, in iron golf club head 30 according to the embodiment of the present invention, by suppressing decrease in resonant time of the hitting sound and reducing the sound pressure in at least one of the fourth-order vibration mode and the fifth-order vibration mode, the hitting sound and the hitting feeling can be improved.

In iron golf club head 30 according to the embodiment of the present invention, badge portion 20 is preferably adhered so as not to overlap with at least one of first small amplitude region 22 and second small amplitude region 24. As a result, unnecessary decrease in resonant time of the hitting sound can be suppressed. In other words, decrease in resonant time of the hitting sound can be minimized. Therefore, decrease in resonant time of the hitting sound can be suppressed more effectively.

In iron golf club head 30 according to the embodiment of the present invention, area A2 of back surface 13 to which badge portion 20 is adhered is preferably 38.6% or more and 40.9% or less of area A1 of the entire back surface 13. As a result, decrease in resonant time of the hitting sound can be suppressed more effectively.

In iron golf club head 30 according to the embodiment of the present invention, head portion 10 preferably has a restitution coefficient of 0.8 or more. As a result, high restitution can be achieved and the hitting feeling can be improved.

Iron golf club 50 according to the embodiment of the present invention includes iron golf club head 30 described above. Therefore, there can be obtained iron golf club 50, in which by suppressing decrease in resonant time of the hitting sound and reducing the sound pressure in at least one of the fourth-order vibration mode and the fifth-order vibration mode, the hitting sound and the hitting feeling can be improved.

Example

Examples of the present invention will be described hereinafter. The same reference characters are allotted to the same or corresponding portions, and the same description will not be repeated.

First, description will be given to each vibration mode of the iron golf club head in the present example.

Each vibration mode was analyzed by means of eigenvalue analysis software Pro/Mechanica manufactured by PTC, with the head alone being in a free state. The eigenvalue of each order was also analyzed by means of the aforementioned eigenvalue analysis software Pro/Mechanica. A legend level of each vibration mode is indicated with "9". At this time, ten legends are displayed.

FIGS. 4A to 4E show the vibration modes of the respective orders of only the back surface. The amplitude in the vibration mode of the entire head is expressed on a scale of 1 to 10, and levels 1 and 2 are expressed as "small", level 3 is expressed as "intermediate", and level 4 or higher is expressed as "large". Since approximately levels 1 to 4 are mainly seen on the back surface, the aforementioned expressions are used. The largest amplitude in the vibration mode of the entire head is mainly seen at the hosel portion and the top edge portion. Therefore, first largest amplitude region 21 of back surface 13 is expressed as level 4 or higher. Second largest amplitude region 23 of back surface 13 is also expressed as level 4 or higher.

FIGS. 4A to 4E show the respective vibration modes when badge portion 20 is not adhered in iron golf club head 30 in the present example. Each of the vibration modes in the first-order to the fifth-order eigenvalues has an antinode portion and a node portion. The antinode portion is a portion where the amplitude is the largest, and the node portion is a portion where the amplitude is the smallest. Since the vibration modes in the first-order to the fifth-order eigenvalues are different from one another, the positions of the antinode portion and the node portion are different in these vibration modes.

A model having a uniform face thickness is used in the present example, and different vibration modes may be obtained in such a model that the face is partly thick. However, in such a model that a difference between the largest face thickness and the smallest face thickness is 0.5 mm or less, almost the same vibration modes are obtained.

Figure 4A:
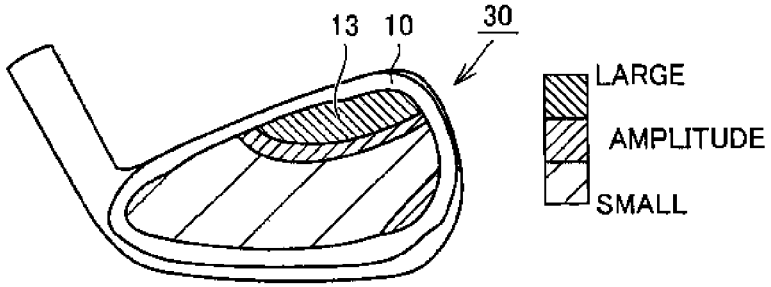
FIGS. 4A to 4E show first-order to fifth-order vibration modes of an iron golf club head in the present example, respectively.

Referring to FIG. 4A, in the vibration mode in the first-order eigenvalue, the antinode portion is located around a portion linking the top edge portion and the toe portion on back surface 13 of head portion 10. The first-order eigenvalue is 2969 Hz.

Figure 4B:
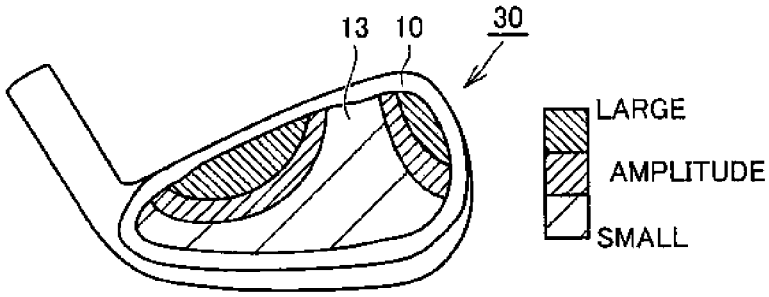

Referring to FIG. 4B, in the vibration mode in the second-order eigenvalue, the antinode portion is located around a portion of the top edge portion on the hosel portion side on back surface 13 of head portion 10. The second-order eigenvalue is 3913 Hz.

Figure 4C:
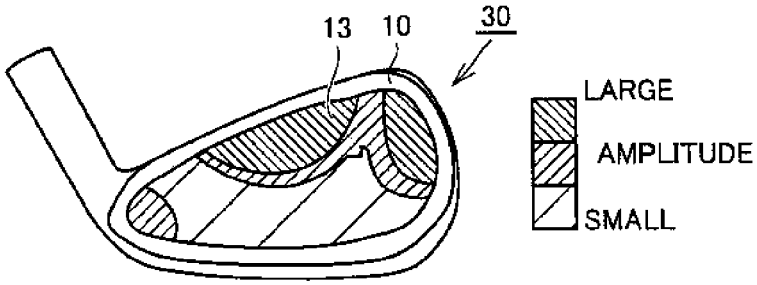

Referring to FIG. 4C, in the vibration mode in the third-order eigenvalue, the antinode portion is located around the central portion of the top edge portion on back surface 13 of head portion 10. The third-order eigenvalue is 5515 Hz.

Figure 4D:
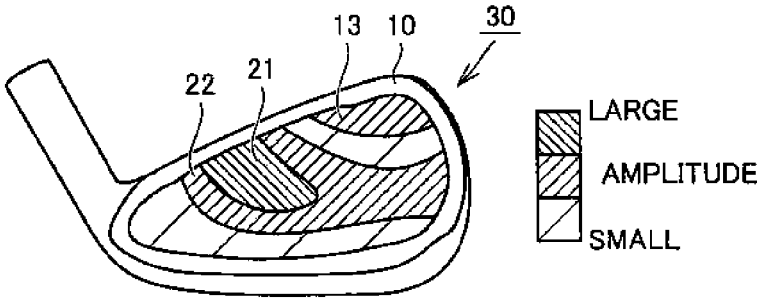

Referring to FIG. 4D, in the vibration mode in the fourth-order eigenvalue, the antinode portion is located in a region extending from the portion around the central portion of the top edge portion to the central portion of back surface 13 on back surface 13 of head portion 10. In other words, first largest amplitude region 21 is located in the region extending from the portion around the central portion of the top edge portion to the central portion of back surface 13. First largest amplitude region (fourth-order largest amplitude region) 21 has an area of substantially 350 $mm^2$. First small amplitude region 22 is located around first largest amplitude region 21 to define first largest amplitude region 21. The fourth-order eigenvalue is 6388 Hz.

Figure 4E:
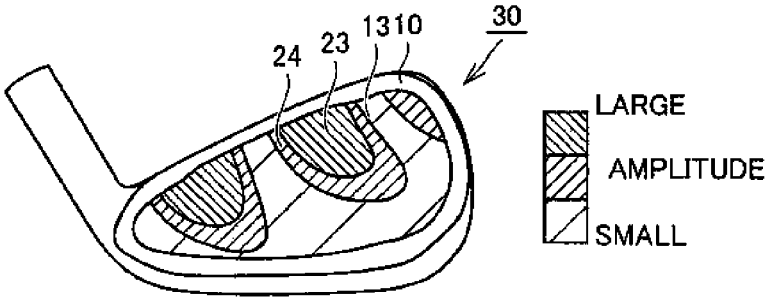

Referring to FIG. 4E, in the vibration mode in the fifth-order eigenvalue, the antinode portion is located in a region extending from the portion around the portion of the top edge portion on the hosel portion side to the central portion of back surface 13 as well as in a region extending from a portion around a portion of the top edge portion on the toe portion side to the central portion of back surface 13, on back surface 13 of head portion 10. In other words, second largest amplitude region 23 is located in the region extending from the portion around the portion of the top edge portion on the hosel portion side to the central portion of back surface 13 as well as in the region extending from the portion around the portion of the top edge portion on the toe portion side to the central portion of back surface 13. Second largest amplitude region (fifth-order largest amplitude region) 23 has a total area of substantially 500 $mm^2$. Second small amplitude region 24 is located around second largest amplitude region 23 to define second largest amplitude region 23. The fifth-order eigenvalue is 9785 Hz.

Next, description will be given to the sound pressure and the resonant time of the iron golf clubs in Comparative Examples A and B and Inventive Examples C to F.

The sound pressure and the resonant time were measured as follows. A hitting point 15 (see FIG. 2) between the third score line and the fourth score line from the sole portion side was hit by a pendulum-type screw hammer and a sound was recorded in an experimental laboratory. The sound pressure and the resonant time were measured for the head alone. TASCAM HD-P2 was used as a measuring device. Bruel & Kjar Sound Quality Type 7698 was used as software. Bruel & Kjar Microphone Type 4190 was used as a microphone. Bruel & Kjar Microphone Type 2804 was used as a power supply for the microphone. Bruel & Kjar Sound Level Calibrator Type 4231 was used as a calibrator. The distance between hitting point 15 and the microphone was set to 20 cm, the measuring time was set to −0.2 to 1.8 seconds, and the window function was set to "Rectangular". At this time, a time when the instantaneous sound pressure was the largest was 0 second. Three hittings were recorded and an intermediate sound pressure value was employed. The resonant time was calculated as a time that elapsed before the sound pressure fell below 0.05 Pa at the end.

Figure 5A:
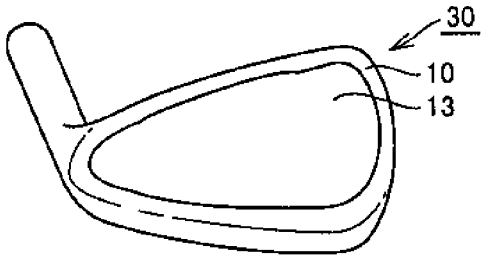
FIGS. 5A to 5F are schematic rear views of iron golf club heads in Comparative Examples and Inventive Examples.

Configurations of iron golf club heads 30 in Comparative Examples A and B and Inventive Examples C to F will be described with reference to FIGS. 5A to 5F. Referring to FIG. 5A, in iron golf club head 30 in Comparative Example A, badge portion 20 is not adhered to back surface 13 of head portion 10. On the other hand, referring to FIGS. 5B to 5F, in iron golf club heads 30 in Comparative Example B and Inventive Examples C to F, badge portion 20 is adhered to back surface 13 of head portion 10.

Referring to FIG. 5A, in iron golf club head 30 in Comparative Example A, back surface 13 of head portion 10 is not covered with badge portion 20.

Figure 5B:
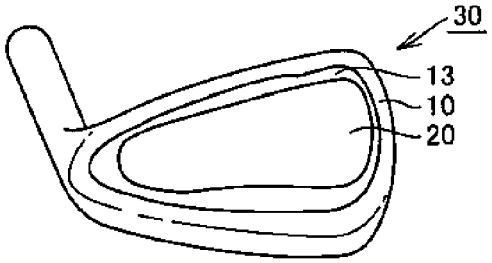

Referring to FIG. 5B, in iron golf club head 30 in Comparative Example B, badge portion 20 is adhered along the outer peripheral shape of back surface 13 to cover almost the entire central portion of back surface 13. Badge portion 20 is adhered to back surface 13 to cover most of back surface 13.

As shown in FIGS. 5C to 5F, in iron golf club heads 30 in Inventive Examples C to F, badge portion 20 is adhered to cover the antinode portion of the vibration mode in at least one of the fourth-order eigenvalue and the fifth-order eigenvalue.

Figure 5C:
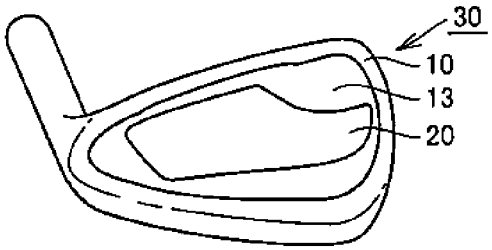

Referring to FIG. 5C, in iron golf club head 30 in Inventive Example C, badge portion 20 is adhered to cover the antinode portion of the vibration mode in the fourth-order eigenvalue. More specifically, badge portion 20 is adhered to cover a region extending from the portion around the central portion of the top edge portion to the central portion of back surface 13. Badge portion 20 is not adhered to the portion linking the top edge portion and the toe portion. An area of badge portion 20 in Inventive Example C covering first largest amplitude region (fourth-order largest amplitude region) 21 is substantially 300 $mm^2$. A ratio of the area of badge portion 20 in Inventive Example C covering first largest amplitude region (fourth-order largest amplitude region) 21 is 85.7%.

Figure 5D:
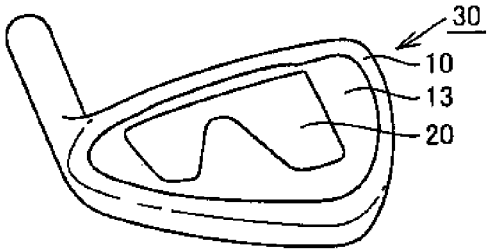

Referring to FIG. 5D, in iron golf club head 30 in Inventive Example D, badge portion 20 is adhered to cover the antinode portion of the vibration mode in the fifth-order eigenvalue. More specifically, badge portion 20 is adhered to cover the region extending from the portion around the portion of the top edge portion on the hosel portion side to the central portion of back surface 13 as well as the region extending from the portion around the portion of the top edge portion on the toe portion side to the central portion of back surface 13. An area of badge portion 20 in Inventive Example D covering second largest amplitude region (fifth-order largest amplitude region) 23 is substantially 360 $mm^2$. A ratio of the area of badge portion 20 in Inventive Example D covering second largest amplitude region (fifth-order largest amplitude region) 23 is 72.0%.

Figure 5E:
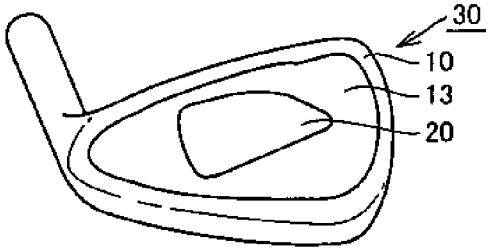

Referring to FIG. 5E, in iron golf club head 30 in Inventive Example E, badge portion 20 is adhered to cover the antinode portion of the vibration mode in the fourth-order eigenvalue. More specifically, badge portion 20 is adhered to cover the region of the central portion of back surface 13. Badge portion 20 in Inventive Example E is smaller in area than that in Inventive Example C described above. An area of badge portion 20 in Inventive Example E covering first largest amplitude region (fourth-order largest amplitude region) 21 is substantially 250 $mm^2$. A ratio of the area of badge portion 20 in Inventive Example E covering first largest amplitude region (fourth-order largest amplitude region) 21 is 71.4%.

Figure 5F:
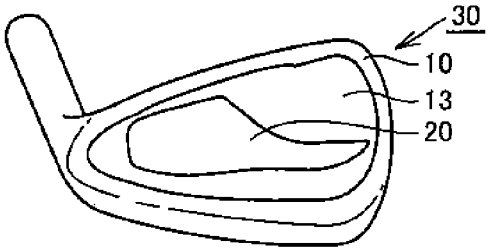

Referring to FIG. 5F, in iron golf club head 30 in Inventive Example F, badge portion 20 is adhered to cover the antinode portion of the vibration mode in the fourth-order eigenvalue. More specifically, badge portion 20 is adhered to cover the region extending from the portion around the central portion of the top edge portion to the central portion of back surface 13 as well as the region extending from the central portion of back surface 13 to the portion of the toe portion on the sole portion side. Badge portion 20 in Inventive Example F is smaller in area than that in Inventive Example C described above. Badge portion 20 in Inventive Example F is larger in area than that in Inventive Example E described above.

Preferably, badge portion 20 in each Inventive Example covers at least 70% of the area of first largest amplitude region (fourth-order largest amplitude region) 21 or the area of second largest amplitude region (fifth-order largest amplitude region) 23. More preferably, badge portion 20 in each Inventive Example covers at least 85% of the area of first largest amplitude region (fourth-order largest amplitude region) 21 or the area of second largest amplitude region (fifth-order largest amplitude region) 23.

Figure 6:
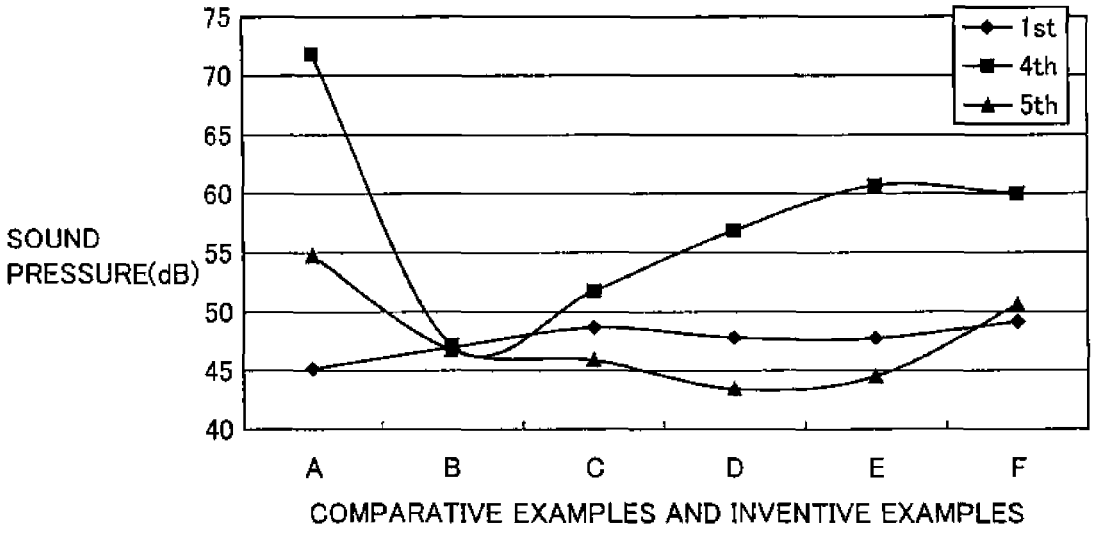
FIG. 6 shows a sound pressure in Comparative Examples A and B and Inventive Examples C to F.

Referring to FIG. 6 and Table 1, the sound pressure (dB) in the fourth-order vibration mode (4th) is smaller in Inventive Examples C, E and F than in Comparative Example A.

TABLE 1

| | sound pressure (dB) | | | sound pressure ratio (%) | |
|---|---|---|---|---|---|
| | 1st | 4th | 5th | 4th | 5th |
| Comparative Example A | 45.1 | 71.8 | 54.7 | 100.0 | 100.0 |
| Comparative Example B | 47.0 | 47.2 | 46.7 | 65.7 | 85.4 |
| Inventive | 48.7 | 51.8 | 45.9 | 72.1 | 83.9 |

TABLE 1-continued

| | sound pressure (dB) | | | sound pressure ratio (%) | |
|---|---|---|---|---|---|
| | 1st | 4th | 5th | 4th | 5th |
| Example C | | | | | |
| Inventive Example D | 47.8 | 56.9 | 43.4 | 79.2 | 79.3 |
| Inventive Example E | 47.8 | 60.7 | 44.5 | 84.5 | 81.4 |
| Inventive Example F | 49.2 | 60.0 | 50.6 | 83.6 | 92.5 |

The sound pressure in the fourth-order vibration mode is smaller in Inventive Example C than in Inventive Example D. This shows that by adhering badge portion 20 to the antinode portion of the fourth-order vibration mode, the sound pressure in the fourth-order vibration mode can be particularly reduced. The sound pressure is larger in Inventive Examples E and F than in Inventive Example C. In Inventive Examples C, E and F, a ratio (%) of the respective sound pressures to the sound pressure in the fourth-order vibration mode in Comparative Example A is 72.1% or more and 84.5% or less.

In addition, the sound pressure in the fifth-order vibration mode (5th) is smaller in Inventive Example D than in Comparative Example A. The sound pressure in the fifth-order vibration mode is smaller in Inventive Example D than in Inventive Examples C, E and F. This shows that by adhering badge portion 20 to the antinode portion of the fifth-order vibration mode, the sound pressure in the fifth-order vibration mode can be particularly reduced. In Inventive Example D, a ratio (%) of the sound pressure to the sound pressure in the fifth-order vibration mode in Comparative Example A is 79.3%.

Figure 7:
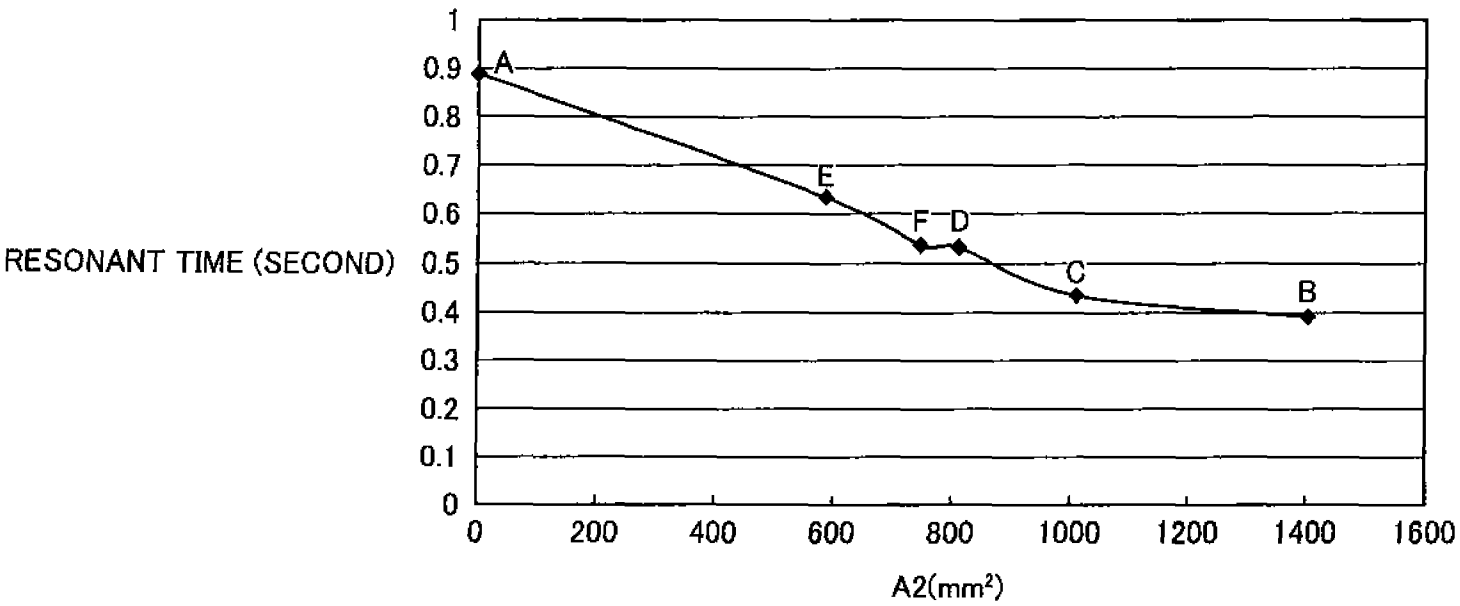
FIG. 7 shows a relationship between a resonant time and an area of a portion to which a badge portion is adhered in Comparative Examples A and B and Inventive Examples C to F.

Referring to FIG. 7 and Table 2, the resonant time (second) is longer in Inventive Examples C to F than in Comparative Example B.

TABLE 2

| | resonant time (second) | resonant time ratio (%) | area A2 of back surface to which badge portion is adhered ($mm^2$) |
|---|---|---|---|
| Comparative Example A | 0.889 | 100.0 | — |
| Comparative Example B | 0.3913 | 44.0 | 1453 |
| Inventive Example C | 0.4353 | 49.0 | 1011 |
| Inventive Example D | 0.5325 | 59.9 | 811 |
| Inventive Example E | 0.6337 | 71.3 | 587 |
| Inventive Example F | 0.5363 | 60.3 | 747 |

This shows that decrease in resonant time can be suppressed in Inventive Examples C to F. In Inventive Examples C to F, a ratio (%) of the respective resonant times to the resonant time in Comparative Example A is 49.0% or more and 71.3% or less. The resonant time is longer in Inventive Examples E and F than in Inventive Example C. This shows that by reducing area A2 of back surface 13 to which badge portion 20 is adhered, the resonant time can be lengthened.

Based on the above, it is confirmed that decrease in resonant time can be suppressed and the sound pressure in at least one of the fourth-order vibration mode and the fifth-order vibration mode can be reduced.

Referring to FIG. 7 and Table 2, it can also be seen that a ratio of decrease in resonant time is reduced when area A2 of back surface 13 to which badge portion 20 is adhered is 800 $cm^2$.

Referring to Table 3, in a number 4 iron golf club (#4) to a number 9 iron golf club (#9) and a pitching wedge (PW), badge portion 20 is adhered such that area A2 of back surface 13 to which badge portion 20 is adhered is 800 $mm^2$. A ratio (A2/A1) of area A2 ($mm^2$) of back surface 13 to which badge portion 20 is adhered to area A1 ($mm^2$) of the entire back surface 13 is 38.6% or more and 40.9% or less.

TABLE 3

| club | area A1 of entire back surface ($mm^2$) | area A2 of back surface to which badge portion is adhered ($mm^2$) | A2/A1 (%) |
|---|---|---|---|
| #4 | 2061 | 800 | 38.8 |
| #5 | 2071 | 800 | 38.6 |
| #6 | 2066 | 800 | 38.7 |
| #7 | 2047 | 800 | 39.1 |
| #8 | 2015 | 800 | 39.7 |
| #9 | 1993 | 800 | 40.1 |
| PW | 1956 | 800 | 40.9 |

Next, further description will be given to changes in sound pressure and resonant time in the fourth-order and the fifth-order vibration modes.

Values in Inventive Examples 1 to 4 described below are each an average value of values obtained as a result of measurement three times. In Inventive Examples 1 and 2, badge portion 20 is adhered to the antinode portion of the fourth-order vibration mode by the double-faced tape. In Inventive Example 1, the double-faced tape has a thickness of 0.4 mm. In Inventive Example 2, the double-faced tape has a thickness of 0.8 mm.

In Inventive Examples 3 and 4, badge portion 20 is adhered to the antinode portion of the fifth-order vibration mode by the double-faced tape. In Inventive Example 1, the double-faced tape has a thickness of 0.4 mm. In Inventive Example 2, the double-faced tape has a thickness of 0.8 mm.

Figure 8:
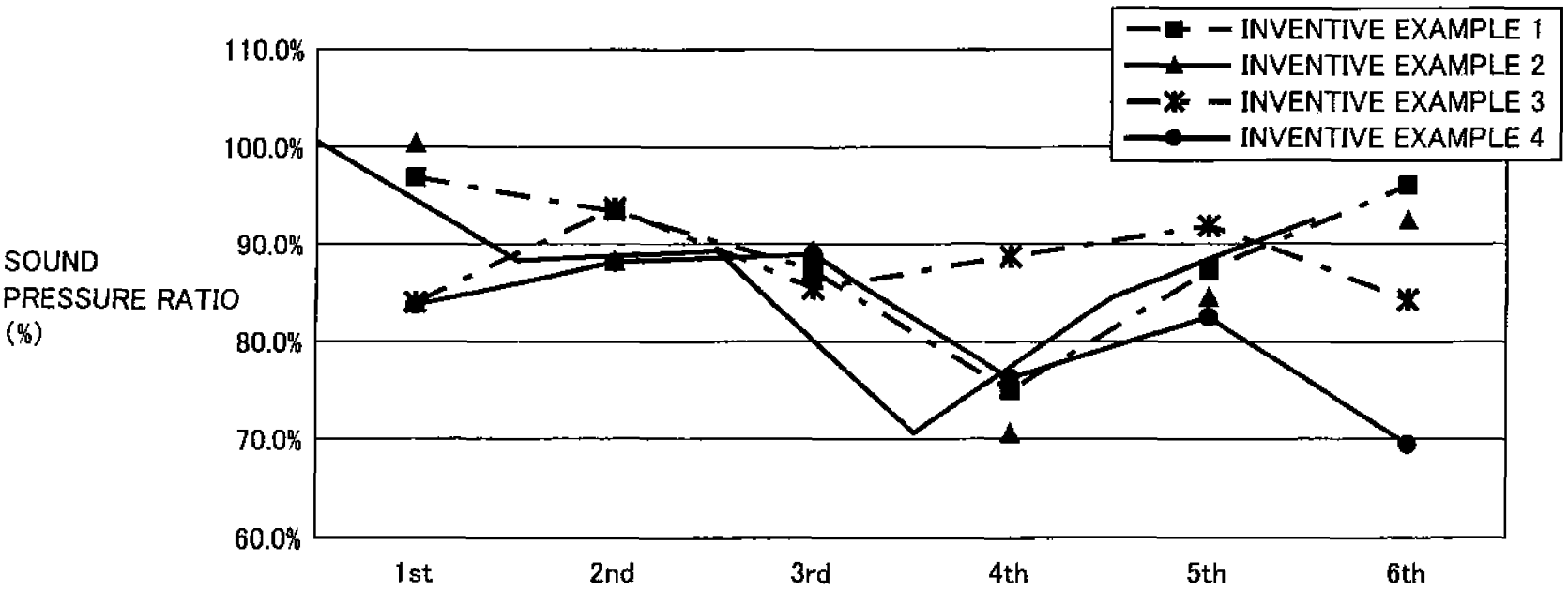
FIG. 8 shows a ratio of a sound pressure in Inventive Examples 1 to 4 with respect to that in Comparative Examples 1 and 2.

Referring to FIG. 8 and Table 4, the sound pressures in the vibration modes in the first-order to the sixth-order eigenvalues in Inventive Examples 1 to 4 are lower than the sound pressure when badge portion 20 is not adhered.

TABLE 4

| | sound pressure ratio (%) | | | | | |
|---|---|---|---|---|---|---|
| | 1st | 2nd | 3rd | 4th | 5th | 6th |
| Inventive Example 1 | 96.8 | 93.3 | 87.3 | 75.0 | 87.3 | 96.0 |
| Inventive Example 2 | 100.4 | 88.2 | 89.3 | 70.6 | 84.6 | 92.4 |
| Inventive Example 3 | 84.1 | 93.7 | 85.5 | 88.7 | 91.8 | 84.3 |
| Inventive Example 4 | 83.8 | 88.1 | 88.9 | 76.2 | 82.5 | 69.5 |

In the fourth-order vibration mode (4th), the sound pressures in Inventive Examples 1 and 2 are particularly low. This shows that by adhering badge portion 20 to the antinode portion of the fourth-order vibration mode, the sound pressure in the fourth-order vibration mode can be particularly reduced.

As compared with the sound pressure when badge portion 20 is not adhered, the sound pressure ratio (%) in Inventive Example 1 is 75.0% and the sound pressure ratio (%) in Inventive Example 2 is 70.6% in the fourth-order vibration mode. It can be seen that the sound pressure is reduced more greatly in Inventive Example 2 in which the double-faced tape is thick than in Inventive Example 1.

In the fifth-order vibration mode (5th), the sound pressures in Inventive Examples 3 and 4 are low. This shows that by adhering badge portion 20 to the antinode portion of the fifth-order vibration mode, the sound pressure in the fifth-order vibration mode can be particularly reduced.

As compared with the sound pressure when badge portion 20 is not adhered, the sound pressure ratio (%) in Inventive Example 4 is 82.5% in the fifth-order vibration mode. It can be seen that the sound pressure is reduced more greatly in Inventive Example 2 in which the double-faced tape is thick than in Inventive Example 1.

Based on the above, it is confirmed in more detail that by adhering badge portion 20 to the antinode portion of the fourth-order and the fifth-order vibration modes, the sound pressure in at least one of the fourth-order vibration mode and the fifth-order vibration mode can be particularly reduced.

Figure 9:
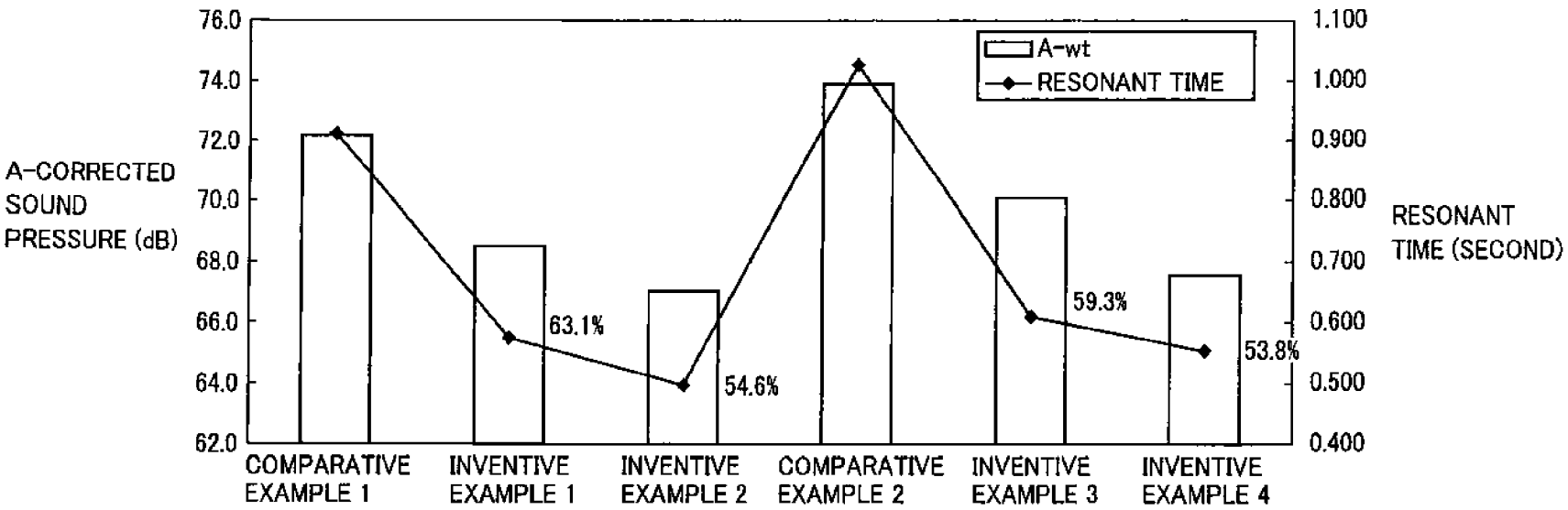
FIG. 9 shows a relationship between an A-corrected sound pressure and a resonant time in Comparative Examples 1 and 2 and Inventive Examples 1 to 4.

The A-corrected sound pressure (A-Weight) and the resonant time in the fourth-order and the fifth-order vibration modes in Inventive Examples 1 to 4 and Comparative Examples 1 and 2 will be described with reference to FIG. 9 and Table 5.

TABLE 5

| | A-corrected sound pressure (dB) | resonant time (second) |
|---|---|---|
| Comparative Example 1 | 72.2 | 0.911 |
| Inventive Example 1 | 68.5 | 0.575 |
| Inventive Example 2 | 67.0 | 0.497 |
| Comparative Example 2 | 73.9 | 1.027 |
| Inventive Example 3 | 70.1 | 0.609 |
| Inventive Example 4 | 67.6 | 0.553 |

Comparative Example 1 is a comparative example in the fourth-order vibration mode and badge portion 20 is not adhered. Area A2 of back surface 13 to which badge portion 20 is adhered in Inventive Examples 1 and 2 is 553 $mm^2$. The A-corrected sound pressures (A-wt) in Inventive Examples 1 and 2 are lower than that in Comparative Example 1. The A-corrected sound pressure in Inventive Example 1 is 68.5 (dB) and the A-corrected sound pressure in Inventive Example 2 is 67.0 (dB).

In addition, the resonant time in Inventive Example 1 is 0.575 second, which is 63.1% of the resonant time in Comparative Example 1, and the resonant time in Inventive Example 2 is 0.497 second, which is 54.6% of the resonant time in Comparative Example 1.

Comparative Example 2 is a comparative example in the fifth-order vibration mode and badge portion 20 is not adhered. Area A2 of back surface 13 to which badge portion 20 is adhered in Inventive Examples 3 and 4 is 820 $mm^2$. The A-corrected sound pressures in Inventive Examples 3 and 4 are lower than that in Comparative Example 2. The A-corrected sound pressure in Inventive Example 3 is 70.1 (dB) and the A-corrected sound pressure in Inventive Example 4 is 67.6 (dB).

In addition, the resonant time in Inventive Example 3 is 0.609 second, which is 59.3% of the resonant time in Comparative Example 2, and the resonant time in Inventive Example 4 is 0.553 second, which is 53.8% of the resonant time in Comparative Example 2.

It can be seen that a rate of decrease in resonant sound in the fourth-order vibration mode is almost equal to a rate of decrease in resonant sound in the fifth-order vibration mode. It can be seen that in both the fourth-order vibration mode and the fifth-order vibration mode, the A-corrected sound pressure and the resonant time are reduced more greatly when the double-faced tape is thick.

In order to check the aforementioned effects, the inventors of the present invention fabricated two types of iron golf clubs 50 including badge portion 20 adhered to the antinode portion of the fourth-order and the fifth-order vibration modes, and four women professional golfers conducted a trial hitting test for these iron golf clubs 50. All women professional golfers who conducted the trial hitting test judged that the hitting feeling of the aforementioned two types of iron golf clubs 50 is excellent. This also shows that by adhering badge portion 20 to the antinode portion of at least one of the fourth-order vibration mode and the fifth-order vibration mode, the hitting feeling can be improved.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An iron golf club head, comprising:
a head portion; and
a badge portion adhered to said head portion,
said head portion including:
a face surface; and
a back surface located behind said face surface, wherein
said badge portion is adhered to at least one of a first largest amplitude region where an amplitude in a fourth-order vibration mode of said back surface is the largest and a second largest amplitude region where an amplitude in a fifth-order vibration mode of said back surface is the largest.

2. The iron golf club head according to claim 1, further comprising:
a first small amplitude region, which is arranged around said first largest amplitude region to define said first largest amplitude region and which is smaller in the amplitude in the fourth-order vibration mode than said first largest amplitude region; and
a second small amplitude region, which is arranged around said second largest amplitude region to define said second largest amplitude region and which is smaller in the amplitude in the fifth-order vibration mode than said second largest amplitude region, wherein
said badge portion is adhered so as not to overlap with at least one of said first small amplitude region and said second small amplitude region.

3. The iron golf club head according to claim 1, wherein
an area of said back surface to which said badge portion is adhered is 38.6% or more and 40.9% or less of an area of entire said back surface.

4. The iron golf club head according to claim 1, wherein
said head portion has a restitution coefficient of 0.8 or more.

5. An iron golf club, comprising:
a shaft with a first end and a second end;
a grip attached to the first end of the shaft; and
an iron golf club head attached to the second end of the shaft, the iron golf club head comprising:
a head portion; and
a badge portion adhered to said head portion,
said head portion including:
a face surface; and
a back surface located behind said face surface, wherein said badge portion is adhered to at least one of a first largest amplitude region where an amplitude in a fourth-order vibration mode of said back surface is the largest and a second largest amplitude region where an amplitude in a fifth-order vibration mode of said back surface is the largest.

* * * * *